United States Patent [19]

Spinnett

[11] Patent Number: 4,508,665

[45] Date of Patent: Apr. 2, 1985

[54] RETROFIT PULSATOR APPARATUS AND METHOD FOR AN AIR/WATER MIXER OF A SWIMMING POOL, THERAPY TUB, SPA OR THE LIKE

[75] Inventor: Raymond G. Spinnett, Santa Ana, Calif.

[73] Assignee: KDI American Products, Inc., North Hollywood, Calif.

[21] Appl. No.: 505,803

[22] Filed: Jun. 20, 1983

[51] Int. Cl.[3] ..... B01F 3/04

[52] U.S. Cl. ..... 261/93; 4/542; 128/66; 239/101; 239/222.17; 239/383; 239/428.5; 261/76; 261/DIG. 75; 366/102

[58] Field of Search ..... 261/76, 78 A, 93, 25, 261/89, 90, 77, DIG. 75; 128/66; 239/101, 102, 383, 416, 222.17, 222.21, 428.5, 443; 4/542; 366/101, 102, 106

[56] References Cited

U.S. PATENT DOCUMENTS

| | | | |
|---|---|---|---|
| 1,101,804 | 6/1914 | Lauter | 128/66 |
| 1,446,887 | 2/1923 | Donovan | 239/383 |
| 2,521,396 | 9/1950 | Moul | 261/93 |
| 2,878,066 | 3/1959 | Erwin | 239/383 |
| 2,990,165 | 6/1961 | Joseph | 261/25 |
| 3,471,091 | 10/1969 | Baker | 239/416 |
| 3,473,736 | 10/1969 | Heitzman | 239/101 |
| 3,568,716 | 3/1971 | Heitzman | 137/624.14 |
| 3,628,529 | 12/1971 | Steimle | 128/66 |
| 3,713,587 | 1/1973 | Carson | 239/383 |
| 3,777,746 | 12/1973 | Kwek | 128/66 |
| 3,890,655 | 6/1975 | Mathis | 4/542 |
| 3,890,656 | 6/1975 | Mathis | 4/542 |
| 3,905,358 | 9/1975 | Jacuzzi | 128/66 |
| 3,946,449 | 3/1976 | Mathis | 4/542 |
| 3,985,303 | 10/1976 | Steimle | 239/428.5 |
| 4,014,961 | 3/1977 | Popov | 261/76 |
| 4,026,470 | 5/1977 | Crist | 239/102 |
| 4,100,917 | 7/1978 | Talge et al. | 4/542 X |
| 4,101,075 | 7/1978 | Heitzman | 239/101 |
| 4,119,686 | 10/1978 | Conger | 261/77 |
| 4,204,646 | 5/1980 | Shames | 239/443 |
| 4,220,145 | 9/1980 | Stamp | 4/542 X |
| 4,264,039 | 4/1981 | Moreland | 261/DIG. 75 |
| 4,320,541 | 3/1982 | Neenan | 261/DIG. 75 |
| 4,340,039 | 7/1982 | Hibbard et al. | 4/542 X |
| 4,379,097 | 4/1983 | Leggett | 261/DIG. 75 |

FOREIGN PATENT DOCUMENTS

| | | | |
|---|---|---|---|
| 2854697 | 6/1979 | Fed. Rep. of Germany | 261/DIG. 75 |

*Primary Examiner*—Richard L. Chiesa

*Attorney, Agent, or Firm*—Gausewitz, Carr, Rothenberg & Edwards

[57] ABSTRACT

To convert a conventional nonpulsating air/water mixer for a therapy tub, swimming pool, spa or the like to a pulsating mixer, an inexpensive pulsator fitting is used to replace the central eyeball portion of the mixer's outlet and mounting fitting. The pulsator fitting has at least one cross bar positioned to block the mixer's aerated water jet, and a small cylindrical rotor journaled on the cross bar. The rotor extends from the cross bar coaxially into the mixer body's outlet passage in the path of the aerated jet. The jet strikes a central portion of the upstream rotor end, travels through an angulated rotor passage, and exits the downstream rotor end at an angle relative to the rotor axis and at a point spaced apart from it, causing the rotor to spin. As the rotor spins, the exiting aerated jet rotates and is repetitively and intermittently blocked by the cross bar, thereby pulsing the jet.

4 Claims, 11 Drawing Figures

FIG. 1.
(PRIOR ART)
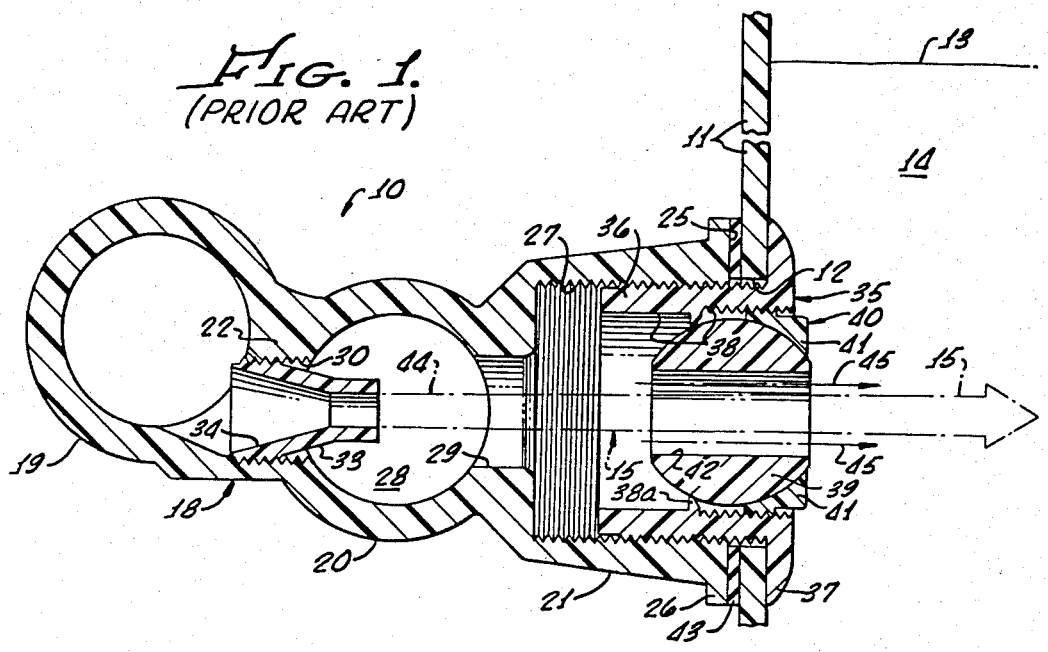
FIG. 3.
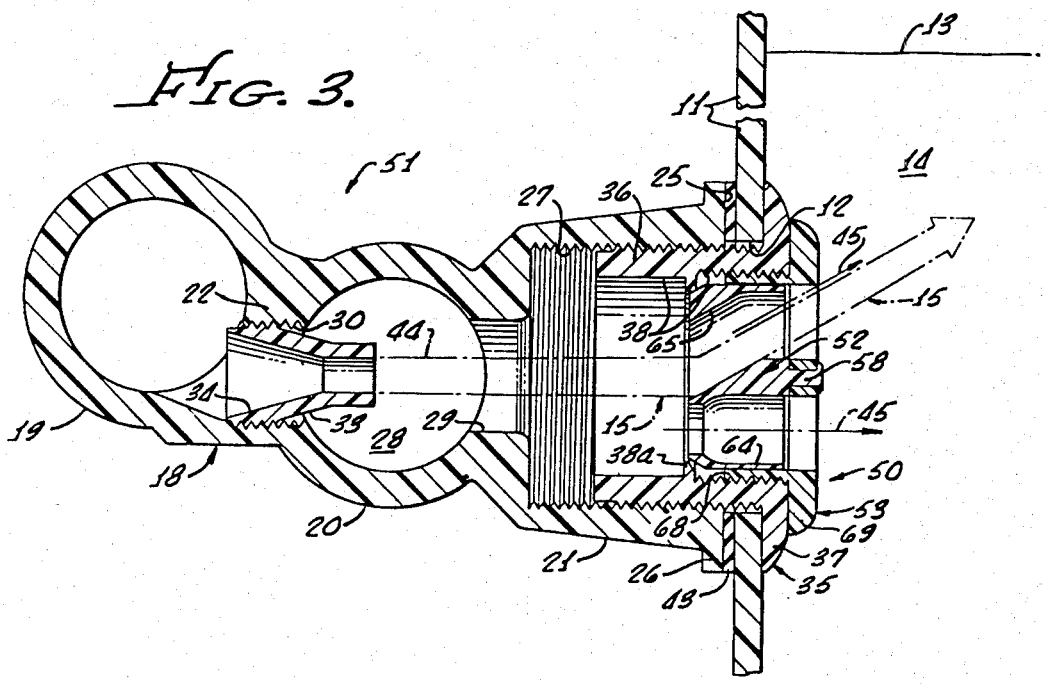
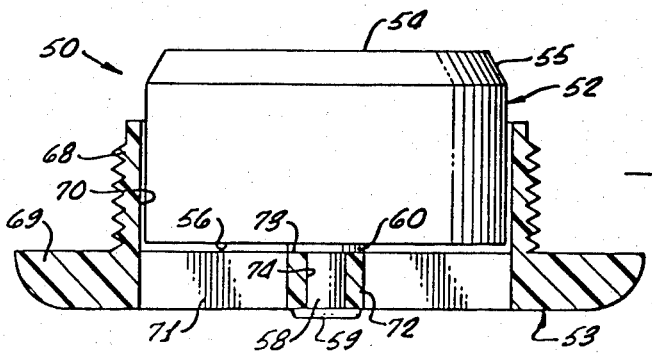
FIG. 2.

FIG. 5.
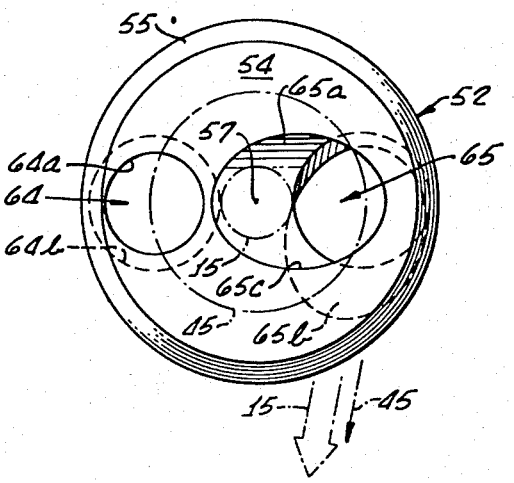
FIG. 9.
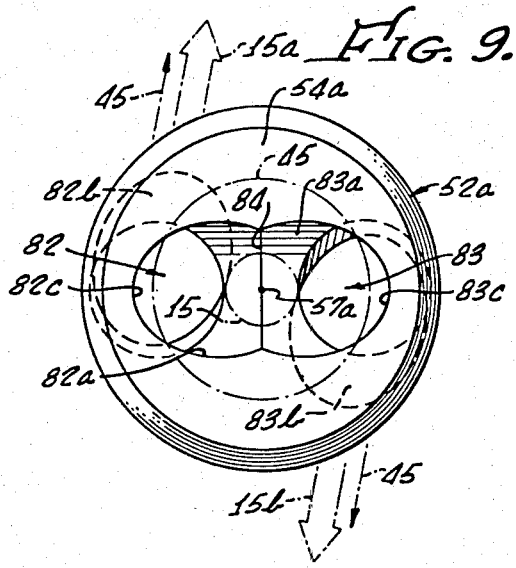
FIG. 6.
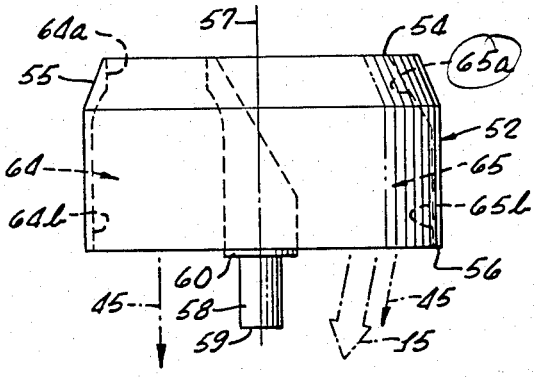
FIG. 10.
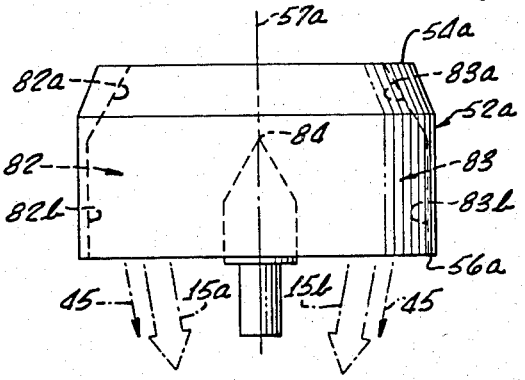
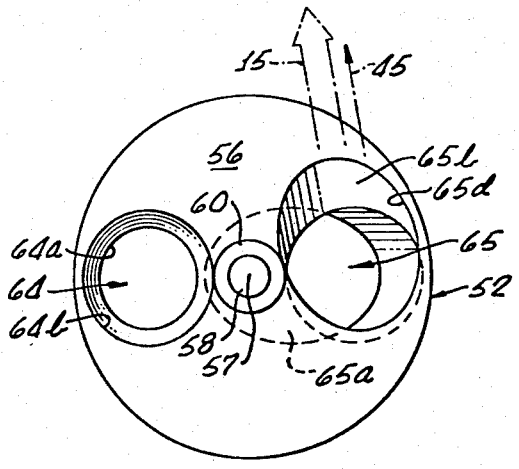
FIG. 7.
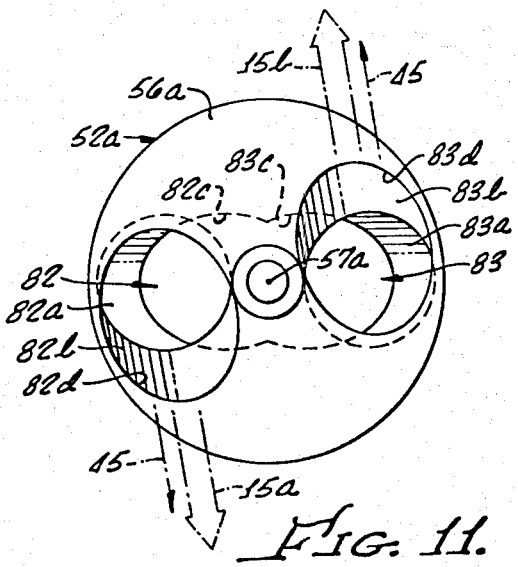
FIG. 11.

RETROFIT PULSATOR APPARATUS AND METHOD FOR AN AIR/WATER MIXER OF A SWIMMING POOL, THERAPY TUB, SPA OR THE LIKE

BACKGROUND OF THE INVENTION

The present invention relates to air/water mixers, and more particularly to methods and apparatus for converting a nonpulsating air/water mixer for a swimming pool, therapy tub, spa or the like to a pulsating mixer.

In spas, therapy tubs, swimming pools and similar apparatus, steady-stream jets of water are projected into the body of water contained in the spa, tub or pool to provide a type of hydromassage, enhanced relaxation and other therapeutic benefits. To increase the action, force and benefit of such jets, the water, before projection, is mixed with air by means of air/water mixers that commonly employ a venturi-type action. Through a forced water supply system feeding each of the mixers, an increased velocity water jet is projected into a mixing chamber within the mixer. The water jet provides an area of reduced pressure (i.e., a water venturi) that pulls air into the chamber through a passage that communicates with ambient atmosphere or a forced air supply system. The air entering the chamber mixes with the water and the resulting aerated water jet is discharged through a nozzle into (below the surface of) the body of water contained in the spa or pool tub.

In the past, to further enhance the therapeutic benefits of the described aeration system, various attempts have been made to cause a pulsation in the aerated jets entering the tub water. One approach has been to intermittently block the water flow to each of the mixers. In an existing system, this requires that the main water supply system be modified by cutting into its supply piping and installing one or more devices which alternately block and unblock such piping. Aside from the expense and inconvenience of this operation (both from an installation and maintenance standpoint), such often complex devices can cause abrupt pressure increases and noise, imposing severe strains on the system, whether they are installed on new or existing systems.

Another approach has been to intermittently interrupt the air flow to the mixers. This, too, often requires cutting into the main supply system and installing air control devices. Such devices generally additionally require external controlling mechanisms and have proven even less desirable than water flow controllers, being less efficient, more complex, and more costly.

A third approach has been to intermittently disable or attenuate the water venturi within each of the mixers. While this method has generally yielded the best performance of the three, its retrofit application is somewhat limited due to the varying internal configurations of air/water mixers of different manufacturers. Stated otherwise, a given venturi-disabling device is often compatible with only one manufacturer's mixer.

Accordingly, it is an object of the present invention to provide an apparatus and method for converting a conventional nonpulsating air/water mixer to a pulsating one that avoids or eliminates above-mentioned and other problems and limitations of prior devices and methods.

SUMMARY OF THE INVENTION

In carrying out principles of the present invention in accordance with a preferred embodiment thereof, means are provided for intermittently and repetitively blocking the exiting, nonpulsating aerated water jet of a conventional air/water mixer employed in an aeration system of a swimming pool, therapy tub, spa or the like to convert the mixer to a pulsating one.

The conventional mixer includes a mixer body having an outlet passage through which a steady air/water jet is projected into the water of the pool, spa or the like through an opening in one of its walls below the water's surface. An outlet and mounting fitting is connected to the outlet passage to secure the mixer body to the wall at the opening. According to a preferred method of the invention, a readily detachable portion of the existing outlet fitting is replaced with a retrofit kit having a blocking member positioned to block the aerated jet, and having means for repetitively effecting shifting of the blocking member and the aerated jet relative to each other transversely of the jet.

BRIEF DESCRIPTION OF THE DRAWINGS

FIG. 1 is a cross-sectional view through a conventional venturi-type air/water mixer attached to a tub wall of a pool, spa or the like for injection of a steady aerated water jet into the tub water;

FIG. 2 is an enlarged side elevational view, partially in cross section, of a pulsator fitting embodying principles of the present invention and adapted to replace a central portion of the outlet and mounting fitting of the mixer of FIG. 1;

FIG. 3 is a cross-sectional view of a pulsating air/water mixer formed by retrofitting the mixer of FIG. 1 with the pulsator fitting of FIG. 2;

FIG. 5 is a view of the upstream end of the pulsator fitting rotor;

FIG. 6 is a side elevational view of the rotor of FIG. 5;

FIG. 7 is a view of the downstream end of the rotor of FIG. 5;

FIG. 9 is a view of the upstream end of the pulsator fitting rotor of FIG. 8;

FIG. 10 is a side elevational view of the rotor of FIG. 8; and

FIG. 11 is a view of the downstream end of the rotor of FIG. 8.

DETAILED DESCRIPTION

Figure 4:
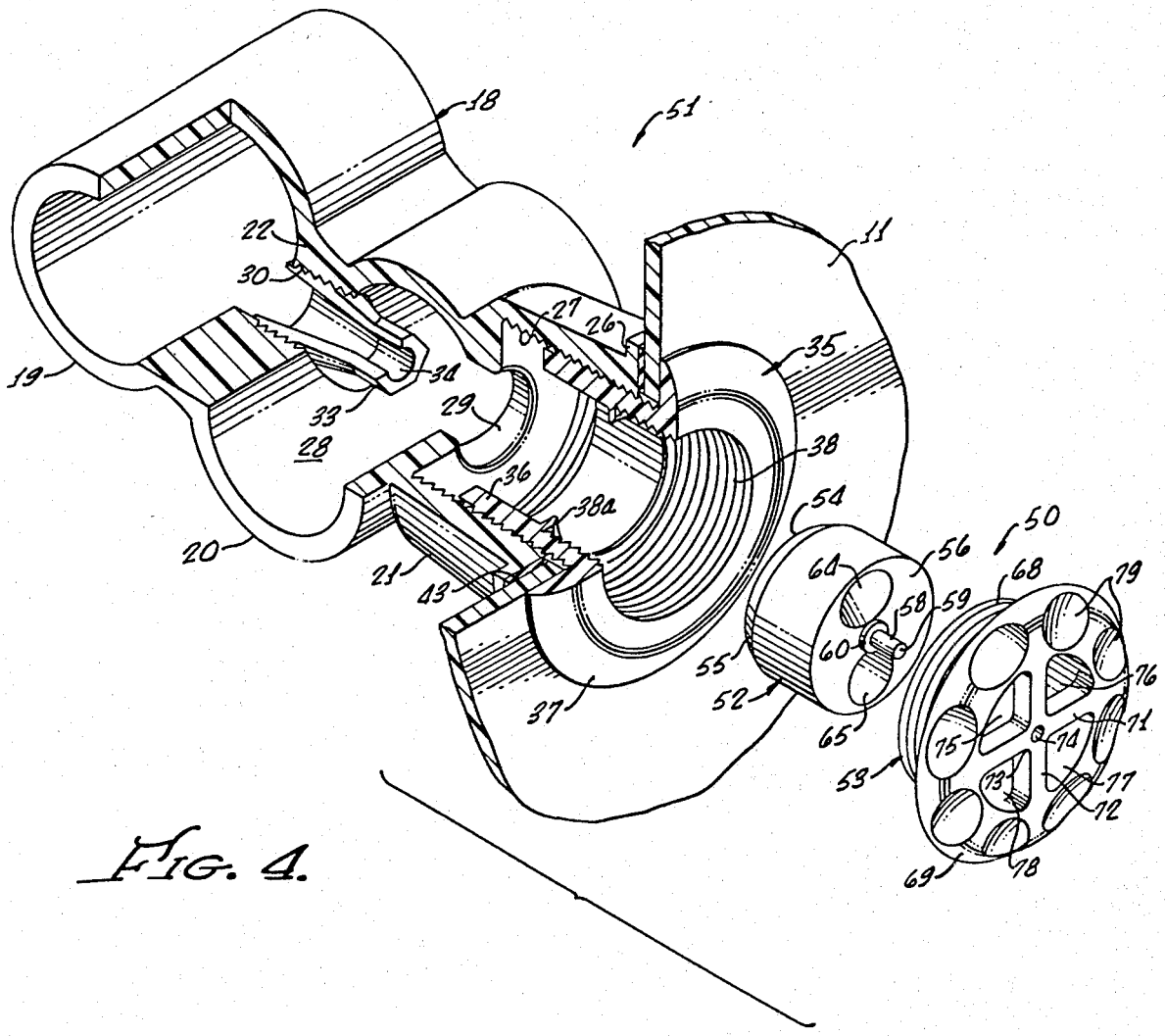
FIG. 4 is an exploded perspective view, with parts broken away, of the retrofitted air/water mixer of FIG. 3.

Illustrated in cross-section in FIG. 1 is a representative conventional venturi-type air and water mixer 10. It is attached to a tub wall 11 of a pool, spa, therapy tub or the like (only a portion of which is shown) at a wall opening 12 below the surface 13 of the tub water 14. The mixer 10, typically one of several attached to the tub wall in a complete system, is used to provide a massaging and therapeutic force upon the body of a user in the tub by injecting a small diameter nonpulsating jet 15 of aerated water through the wall opening into the tub. The present invention provides a simple and inexpensive method for rapidly converting each of the conventional mixers in the tub's aeration system to a pulsating mixer, thus imparting a soothing "massaging" action to the agitated water. Before describing an apparatus and method of the invention, however, the structure and operation of the conventional mixer 10 will first be briefly described.

The mixer 10 is formed entirely of molded plastic and includes a body 18 having, from left to right in FIGS. 1 and 4, a cylindrical open-ended water conduit section 19, a cylindrical open-ended air conduit section 20, and a generally cylindrical mixture outlet section 21. Water and air conduits 19, 20, are of equal length and diameter and are joined in a longitudinally aligned, parallel, closely juxtaposed relationship by a common wall 22. Water conduit 19, which serves as a water inlet port for the mixer 10, is offset slightly upwardly of air conduit 20.

Mixture outlet section 21 projects radially and horizontally outwardly from a central longitudinal portion of air conduit 20, water conduit 19 and outlet section 21 being on generally opposite sides of air conduit 20. At the outer end 25 of outlet section 21 is a radially outwardly projecting perimetral mounting flange 26. Extending inwardly through the outer end 25 is an internally threaded axial bore or air/water mixture outlet passage 27 which communicates with the interior 28 of air conduit 20 through a smaller coaxial bore or mixture outlet port 29.

Axially aligned with the bores 27 and 29 is an internally threaded opening 30, formed through a lower portion of the common wall 22, which threadedly receives the externally threaded upstream portion of a small plastic internal water nozzle 33. Nozzle 33 projects radially into the air conduit interior 28 and has a converging (from left to right in FIG. 1) circular axial opening 34 formed therethrough that defines a water inlet port from water conduit 19 into air conduit 20. As will be seen, the air conduit interior 28 serves both as air inlet means for the mixer 10 and as an air/water mixing chamber therein.

The mixer body 18 is secured to the tub wall 11 at the opening 12 by means of an outlet and mounting fitting 35 which is also formed from molded plastic. Outlet and mounting fitting 35 comprises a cylindrical, externally threaded hollow stem 36 having at one end thereof a radially outwardly extending perimetral mounting flange 37. Extending axially through the fitting 35 is a cylindrical bore 38 which is internally threaded along a flange end portion of the stem 36. At the inner termination of such threaded portion of bore 38 is formed a radially inwardly projecting conical seat **38*a* upon which rests a truncated spherical eyeball 39 that is held in place by a plurality of circumferentially spaced projections 40 on a nut 41 that is threadedly engaged with the internally threaded portion of the bore 38. Eyeball 39 has formed therethrough a circular aperture 42 whose diameter is larger than that of the aerated water jet 15. With the fitting 35 and its eyeball 39 in place, the aperture 42 forms a reduced area continuation of the mixture outlet passage 27**.

For reasons described below, it is important to note at this point that while the external and internal configuration and construction of the mixer body 18 can vary widely in the air/water mixer industry, the size and configuration of the illustrated central eyeball portion of the outlet and mounting fitting, and the internally threaded bore and conical seat in which it is mounted, are quite standard throughout such industry. More specifically, the eyeball and its retaining nut (which may be formed integrally with the eyeball) of one manufacturer's outlet and mounting fitting may usually be readily interchanged with their counterparts in another manufacturer's outlet and mounting fitting. This is the case even where the mixer bodies and outlet and mounting fittings of different manufacturers are not interchangeable.

The outlet and mounting fitting 35 is used to secure the mixer body 18 to the tub wall 11 by inserting the stem 36 outwardly through the wall opening 12, threading it into the bore 27 in the body 18, and tightening it to draw the body flange 26 against a sealing gasket 43 interposed between the exterior surface of the wall 11 and the flange 26.

Through piping systems not shown, water at relatively high pressure is forced through water conduit 19, and air is introduced into the mixing chamber 28 of the air conduit 20 of the mounted mixer 10 from ambient atmosphere or an air blower. The high pressure water is forced through the internal nozzle 33 and into the mixing chamber 28 where it forms a relatively high velocity, small diameter water stream 44. The stream 44 is expelled from the mixing chamber 28 through the mixture outlet port 29, the mixture outlet passage 27 and the eyeball orifice 42 into the tub water 14. A venturi action of the water stream 44 within the mixing chamber 28 entrains air into the stream, thereby converting it to the aerated water jet 15 which enters the tub water.

Not only is air entrained in the high velocity water stream within the mixing chamber, but air surrounding the stream (but not entrained in it) is forced rapidly through the eyeball orifice 42, as indicated by arrows 45 in FIG. 1, because of surface tension between the moving water stream and the air surrounding it. Because the diameter of the eyeball orifice 42 is somewhat larger than the diameter of the exiting water jet 15, the air 45 carried around the jet's perimeter is forced outwardly by its own momentum through the eyeball orifice 42 to provide additional aeration of the tub water.

The present invention provides a pulsator fitting or retrofit kit 50, illustrated in FIG. 2, which is simply substituted for the standard eyeball 39 and retaining nut 41 of the conventional mixer 10 to convert it to a pulsating mixer 51 depicted in FIGS. 3 and 4.

As will be seen, the pulsation of the retrofitted mixer is achieved by an intermittent blocking (and thus "pulsing") of the aerated jet 15 as it exits the mixer. Additionally, the pulsed jet 15 is caused to rotate about the axis of the outlet section 21 of the mixer body 18 to form a spiral swirling action as it enters the tub water, creating a pleasurable water motion and enhanced massaging action. Importantly, this addition of a pulsating, swirling action to the aeration system is achieved without the use of tools, without dismantling or modifying the main air and water supply systems, without modification or replacement of the existing mixer bodies, and without even removing the outlet and mounting fitting. Because of the simplicity of the illustrated retrofit apparatus, one unskilled person can convert all mixers of an entire steady-stream tub aeration system to the described pulsating and swirling arrangement in a manner of minutes at a minimal cost and with extremely little, if any, subsequent maintenance.

Referring to FIGS. 2 through 7, a novel pulsator fitting 50, which embodies principles of the present invention, has a molded plastic rotor portion 52 and a molded plastic stator or flow-disturbing member portion 53. Rotor 52 is of a right circular cylindrical shape and has an upstream end 54 having a bevel 55 around its perimeter, a downstream end 56, and a longitudinal axis 57 (FIGS. 5 through 7). The length of the rotor is approximately equal to the length of the threaded portion of the bore 38 in the outlet and mounting fitting 35, and its diameter is smaller than the diameter of bore 38. Projecting axially outwardly of the downstream rotor end 56 is a fixed central pin or shaft 58 having an outer end 59. The base of the pin 58 is radially enlarged to form a narrow cylindrical thrust bearing 60.

Referring to FIGS. 5 through 7, two generally diametrically opposite flow passages, 64 and 65, extend completely through the rotor from its upstream end 54 to its downstream end 56. Passage 64 extends straight through the rotor 52 in an axial direction, being offset from the rotor axis. It is defined by a circular bore 64*a* extending a short distance through the upstream rotor end between its perimeter and the rotor axis 57, and a larger, coaxial circular bore 64*b* extending through the rotor downstream end and communicating with bore 64*a*. As will be seen, passage 64 functions as an auxiliary air supply passage to deliver a portion of the air 45 (which, as previously mentioned, is peripheral to and transported by the aerated jet 15) to the tub water from the retrofitted mixer 51. It additionally functions, as described below, as a balancing port to help balance air and water forces imposed on the rotor.

Unlike passage 64, passage 65 does not extend straight through the rotor 52, but is a dog-leg passage comprising mutually angulated upstream and downstream legs respectively defined by circular cross-section bores 65*a* and 65*b* formed through or molded in the ends 54, 56 of the rotor. Each of the bores 65*a*, 65*b* is angled relative to the plane of the end face through which it enters the rotor. The bores thus form eliptical openings 65*c* and 65*d*, respectively, in the rotor ends 54 and 56 as illustrated in FIGS. 5 and 7.

For reasons described below, the upstream end opening 65*c* is positioned immediately adjacent the bore 64*a* (FIG. 5) and circumscribes the rotor axis 57. From the end opening 65*c* the axis of the upstream leg 65*a* extends downwardly (as viewed in FIG. 6) through a portion of the rotor away from the passage 64 at an angle (approximately 31° in the illustrated embodiment) relative to the rotor axis 57 and in a first plane containing axis 57. The upstream leg 65*a* terminates within the rotor adjacent the rotor perimeter.

The axis of the downstream leg 65*b* forms an angle with the axis of the upstream leg 65*a*, the axes of legs 65*a*, 65*b* lying in a second plane. Such second plane forms an angle with the first plane, which contains the axes of the rotor and the upstream passage leg. More specifically, relative to the rotor 52, the upstream leg 65*a* is sloped radially outwardly from the upstream rotor end 54 (i.e., to the right in FIG. 5), and the downstream leg 65*b* is sloped tangentially (i.e., all points on its axis being substantially equidistant from the rotor axis 57, leg 65*b* sloping generally downwardly toward downstream end 56 in FIG. 5). Although the axis of the downstream leg 65*b* does not lie in a plane with the rotor axis 57, it too forms an angle (approximately 31° in the illustrated embodiment) with the rotor axis.

Referring to FIGS. 2 and 4, the stator 53 comprises an externally threaded cylindrical stem portion 68 having a radially outwardly extending circular perimetral flange 69 at one end thereof, the flange 69 having a diameter somewhat smaller than that of the mounting flange 37. The stem 68 has the same external diameter and thread pattern as the internally threaded portion of the outlet and mounting fitting bore 38. Extending completely through the stem 68 is an axial bore 70 that has a diameter slightly larger than the diameter of the rotor 52.

A pair of perpendicular, intersecting blocking members or cross bars 71 and 72 are fixed at their ends to the interior of the stem 68 at its flange end and extend across the bore 70. The juncture 73 of the cross bars is positioned at the longitudinal axis of the stem 68 and has formed axially therethrough a circular aperture or socket 74. The cross bars 71 and 72 define four circumferentially spaced stator outlet openings, 75 through 78, in the flange end of the stem 68. These stator outlet openings, together with the stator bore 70, define continuations of the mixture outlet passage of the mixer body when the pulsator fitting is connected thereto. To assist in installing the retrofit kit 50 as described below, a circumferentially extending series of indentations or finger grips 79 are formed in the outer face of the flange 69.

As indicated in FIGS. 2 and 3, the rotor 52 is rotatably mounted in the stator bore 70 with the pin 58 projecting outwardly through the socket 74 and the rotor thrust bearing 60 engaging the inner surface of the cross bar juncture 73. To preclude separation of the rotor 52 and the stator 53, the outer end 59 of the pin 58 is expanded against the outer surface of the cross bar juncture 73. The upstream end 54 of the rotor projects outwardly of the nonflanged end of the stem 68.

The method of the present invention is extremely simple and is apparent from the drawings. To convert the conventional, nonpulsating mixer 10 to the pulsating mixer 51, the existing eyeball 39 and its retaining nut 41 are first removed from the existing outlet and mounting fitting 35. Next, the pulsator fitting 50 is simply screwed into the outlet fitting bore 38 until the pulsator flange 69 contacts the existing mounting flange 37 as indicated in FIG. 3. When in place, the rotor 52 extends along nearly the entire length of the threaded portion of bore 38 and substantially blocks the mixture outlet passage 27. The rotor bevel 55 precludes interference between the rotor and the internal eyeball seat 38*a*. The upstream end 54 of the rotor faces the internal water nozzle 33 which is axially aligned with the rotor.

Because the bore 38 in the existing outlet and mounting fitting 35 is of a standard size, the pulsator fitting 50 will fit nearly all conventional nonpulsating mixers without modification.

A feature of the present invention which permits such wide retrofit applicability of the pulsator fitting is its unique method of creating the desired aerated jet pulsation. Unlike previous pulsation apparatus, it does not alter or obstruct either the incoming mixer water flow, the incoming mixer air flow, or the internal water venturi mechanism. Instead, it takes the much simpler and less expensive approach of acting upon the aerated water jet after it is formed, and does so at the standard terminal portion of the aeration system, the common denominator of a wide variety of conventional mixers.

During operation of the retrofitted mixer 51, the aerated water jet 15 impinges upon the rotor 52 within the confines of the eliptical end opening 65*c* as indicated in phantom in FIG. 5. The jet 15 then flows through the upstream and downstream passage legs 65*a* and 65*b*, exiting the rotor through the eliptical downstream end opening 65*d* in the directions indicated in phantom in FIGS. 5 and 7.

Because of the relative angulation and radial displacement of the downstream leg 65*b*, the exiting jet 15 has a tangential force component (i.e., a force component transverse to and spaced from the rotor axis) which causes the rotor 52 to rapidly spin in a counterclockwise direction as viewed in FIG. 5. The path through which the jet 15 traverses the rotor is thus caused to rotate about the rotor axis. It should be noted that because the eliptical upstream end opening 65*c* circumscribes the rotor axis 57, the jet 15 always strikes the rotor within the boundaries of such end opening regardless of the rotor's rotational position.

During operation of the mixer 51 the jet-transported peripheral air 45 also impinges upon the upstream end of the rotor and is indicated in phantom in FIG. 5. A large portion of this impinging air body enters the end opening 65*c* and is forced through the passage 65 with the jet 15. Some of the peripheral air 45 also strikes the rotor within the boundaries of the auxiliary bore 64*a*. This portion of the impinging air is driven by its own momentum through the passage 64 and out the downstream end of the rotor. It can be seen that if the passage 64 were eliminated (which it may be if desired) less air would be delivered to the tub water. The passage 64 thus serves as an auxiliary air passage through the rotor. By allowing air to pass through it (which, in the absence of passage 64, would impinge on the rotor diametrically opposite its end opening 65*c*), passage 64 also helps to dynamically balance the rotor.

As the jet 15 and the air 45 leave the rapidly revolving rotor, they are projected sequentially outwardly through the stator outlet openings 75 through 78. However, in one revolution of the rotor, both the jet 15 and the streams of air 45 are blocked four times by the fixed cross bars 71 and 72. This intermittent and repetitive blocking of the rotating exiting jet 15 and air 45 causes the desired pulsing of the retrofitted mixer.

The pulsator fitting 50 not only causes the jet 15 to pulse (and thereby "massage" the tub's users), but widens and softens its agitation pattern as well. This more gentle agitation is due to the fact that the jet 15, because it is rapidly revolving as it enters the tub water and is angled relative to the rotor axis, enters the tub in a diffused, spiral pattern as opposed to the more powerful, axially directed jet of the conventional mixer 10.

Figure 8:
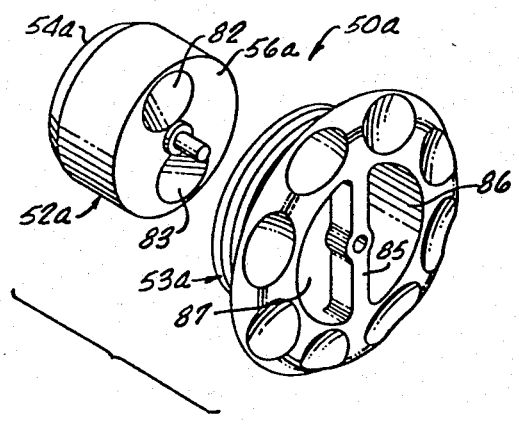
FIG. 8 is an exploded perspective view of an alternate embodiment of the pulsator fitting.

An alternate embodiment, 50*a*, of the pulsator fitting 50 is depicted in FIG. 8 and includes a modified rotor 52*a* and a modified stator of flow-disturbing member portion 53*a*. Both the rotor 52*a* and the stator 53*a* are substantially the same size and shape as their counterparts 52 and 53, and are rotatably connected to each other in the same manner, but are altered as described below to provide a different aeration and agitation action when assembled and connected to the existing outlet and mounting fitting 35 as described for the pulsator fitting 50.

Referring to FIGS. 8 through 11, the rotor 52*a* has a pair of generally diametrically opposite mixture flow passages 82 and 83 formed completely through it from its upstream end 54*a* to its downstream end 56*a*. The passages 82 and 83 are dog-leg passages comprising, respectively, mutually angulated upstream and downstream legs 82*a* and 82*b*, and 83*a* and 83*b*. Each of these legs is defined by a circular bore formed through or molded in one of the rotor ends at an angle to the plane of such end. The upstream legs 82*a* and 83*a* form eliptical openings 82*c* and 83*c* in the rotor end 54*a* (FIG. 9) which intersect along a central portion of end 54*a*. The upstream legs 82*a* and 83*a* intersect below (as viewed in FIG. 10) the rotor end 54*a* and form an intersection edge 84 within the rotor 52*a* and passing through its longitudinal axis 57*a*. From their entry openings 82*c* and 83*c*, the upstream legs 82 and 83 slope downwardly and radially outwardly from the axis 57*a* in opposite directions. Each of the legs 82*a* and 83*a* thus forms an angle (of approximately 35° in the illustrated embodiment) with the rotor axis 57*a*. The axes of the radially outwardly directed upstream legs 82*a* and 83*a* lie in a plane with the rotor axis 57*a*.

The downstream passage legs 82*b* and 83*b*, respectively, are angled relative to the upstream legs 82*a* and 83*a* in opposite directions relative to each other and are each angled (by approximately 20° relative to the rotor axis 57*a*. Legs 82*b* and 83*b* exit the rotor 52*a* through eliptical openings 82*d* and 83*d* in the downstream rotor end 56*a*. The axes of the downstream legs 82*b* and 83*b* lie in planes with the axes of the upstream legs 82*a* and 83*a* which form angles with the plane containing the rotor axis 57*a* and the axes of the upstream legs 82*a* and 83*a*.

With the pulsator fitting 50*a* connected to the existing outlet and mounting fitting 35 (as described for pulsator fitting 50), the aerated jet 15 impinges upon the passage intersection edge 84 as illustrated in FIG. 9. The edge 84 splits the incoming jet 15 into two separate streams 15*a* and 15*b* which are respectively projected through the passages 82 and 83. Because of the central positioning of the upstream rotor end openings 82*a* and 83*a*, the jet is always projected through the twin rotor passages regardless of the rotor's angular position. The twin streams 15*a* and 15*b* exit the rotor through the downstream end openings 82*d* and 83*d* and, because of the mutually opposite angulation of the downstream legs 82*b* and 83*b*, have oppositely directed tangential force components as indicated in phantom in FIGS. 9 and 11, both such force components tending to drive the rotor in the same direction. Both exiting mixture streams 15*a* and 15*b* thus cause the rotor 52*a* to spin in a counterclockwise direction as viewed from its upstream end in FIG. 9. As indicated in FIGS. 9 through 11, portions of the impinging peripheral air 45 also flow through the passages 82 and 83. Because the twin mixture passages are diametrically opposite and transport equal fluid volumes, this rotor embodiment is inherently dynamically balanced.

The only modification present in the stator 53*a* is that it has only one cross bar 85. Thus, there are only two stator outlet openings, 86 and 87. During one revolution of the stator 52*a*, each of the twin aerated water streams 15*a* and 15*b* is simultaneously blocked twice by the single cross bar 85. Thus, the pulsation rate of the replacement fitting 50*a* is one-half that of the replacement fitting 50 whose single aerated water stream 15 is blocked four times in one revolution of the rotor 52. Additionally, the replacement fitting 50*a* has a gentler aeration and agitation action than the replacement fitting 50 because of the splitting of the jet 15. Because each of the separated streams 15*a* and 15*b* has only half the volume of the original stream 15, the momentum of each is halved. If desired, the passage leg angles of the rotors 52, 52*a* may be modified to alter the exit angles of the aerated jet to increase or decrease its rotor driving force.

By simply interchanging rotors and stators, four different permutations of the pulsator fitting may be constructed, each permutation having a different frequency or agitation action than each of the others. More specifically, each of the rotors 52 and 52*a* may be coupled with either the stator 53 or the stator 53*a*. For example, by connecting the rotor 52 to the stator 53*a*, the mixer pulsation rate is halved. Similarly, by connecting the rotor 52*a* to the stator 53, the same gentler agitation action of rotor 52*a* is maintained, but the resulting pulsation frequency is doubled. Other combinations and numbers of rotor passages and stator cross bars may also be employed.

The angulated rotor passages perform dual functions, flowing the air/water mixture along a circular path or paths and effecting rotation of the rotor itself. It will be readily appreciated that, if desired, these two functions could be separated. For example, the rotor mixture passage or passages could be formed straight through the rotor along an axis or axes angled relative to the rotor axis and other means, such as vanes or the like, could be employed to rotate the rotor.

Since the described apparatus comprises only two simple, inexpensive parts and is driven by the exiting aerated water jet itself, the complexity and relatively high cost of prior pulsation conversion apparatus is eliminated. Because the main air and water supply systems are not intermittently blocked, no additional stress is imposed on them and no external controlling devices are required. Moreover, the owner of the pool or spa can easily accomplish the entire pulsation conversion himself. He can just as easily subsequently reconvert the aeration system to a nonpulsating one, if desired, by merely removing the pulsator fittings and reconnecting the removed eyeball fittings.

The foregoing detailed description is to be clearly understood as given by way of illustration and example only, the spirit and scope of this invention being limited solely by the appended claims.

What is claimed is:

1. For use with a swimming pool, therapy tub, spa or the like having a wall confining a body of water, a pulsating air/water mixer for projecting an air/water mixture through said wall into said body of water below its surface, said pulsating mixer comprising:

(a) a mixer body having:
  (1) an air/water mixing chamber,
  (2) an air/water mixture outlet passage communicating with said mixing chamber and opening outwardly through said mixer body,
  (3) water input means for projecting an increased velocity water stream through said mixing chamber, whereby air in said chamber is mixed with said water stream to form an air/water mixture stream, and whereby said air/water mixture stream is projected outwardly through said mixture outlet passage, and
  (4) an input means for flowing air into said mixing chamber for mixture with said water stream; and (b) means for repetitively and intermittently blocking said projected air/water mixture stream to cause a pulsation therein, said blocking means comprising a cross bar fixed to and extending across an outer end of said mixture passage, at a portion adapted to be immersed in said body of water, and a rotor journalled in said cross bar, said rotor having an offset dog-leg passage therethrough for flowing said air/water mixture stream toward said cross bar and for rotating said rotor, said dog-leg passage having an upstream end that circumscribes the axis of said rotor.

2. For use with a swimming pool, therapy tub, spa or the like having a wall confining a body of water, a pulsating air/water mixer for projecting an air/water mixture through said wall into said body of water below its surface, said pulsating mixer comprising:

(a) a mixer body having:
  (1) an air/water mixing chamber,
  (2) an air/water mixture outlet passage communicating with said mixing chamber and opening outwardly through said mixer body,
  (3) water input means for projecting an increased velocity water stream through said mixing chamber, whereby air in said chamber is mixed with said water stream to form an air/water mixture stream, and whereby said air/water mixture stream is projected outwardly through said mixture outlet passage, and
  (4) air input means for flowing air into said mixing chamber for mixture with said water stream; and (b) means for repetitively and intermittently blocking said projected air/water mixture stream to cause a pulsation therein, said blocking means comprising:
  (1) a rotor;
  (2) a blocking member mounted in an end of said mixture outlet passage,
  (3) means for mounting said rotor on said blocking member in the path of said air/water mixture stream between said mixing chamber and said blocking member for rotation relative to said blocking member about an axis extending between said mixing chamber and said blocking member, and
  (4) air/water mixture passage means extending through said rotor for defining a path through which said air/water mixture may be continuously projected, said path rotating with said rotor about said axis and intersecting said blocking member during only a portion of its revolution, said passage means including means for rotating said rotor about said axis in response to a flow of said air/water mixture therethrough, whereby an air/water mixture is passed through said blocking member into said body of water with a pulsating and swirling action,
  (5) said rotor being of a circular cylindrical shape having an upstream end and a downstream end, and said mixture passage means comprising an opening extending therethrough in a first leg from a central area of said upstream end and extending from said first leg to said downstream end in a second leg, said first leg having an axis angled in a first plane relative to the axis of said rotor, said second leg having an axis angled relative to said axis of said first leg and angled in a second plane relative to said rotor axis, said second plane being angled relative to said first plane.

3. The pulsating mixer of claim 2 further comprising an auxiliary aeration passage formed through said rotor from said upstream end to said downstream end and positioned substantially diametrically opposite said first-mentioned opening through said rotor, said auxiliary passage forming a path through said rotor through which air may flow from said mixing chamber into said body of water.

4. The pulsating mixer of claim 2 further comprising a second air/water mixture opening extending through said rotor from said upstream end to said downstream end, said second mixture opening being positioned substantially diametrically opposite said first-mentioned opening through said rotor and including first and second legs angled in mutually different planes relative to said rotor axis and in directions respectively opposite to the angular directions of said first and second legs of said first-mentioned opening through said rotor.

* * * * *